United States Patent [19]

Pilolla et al.

[11] Patent Number: 5,031,337

[45] **Date of Patent: * Jul. 16, 1991**

[54] AUTOMATIC HAND DRYER

[75] Inventors: Joseph J. Pilolla, Elmhurst; John R. Wilson, Naperville, both of Ill.

[73] Assignee: Sloan Valve Company, Franklin Park, Ill.

[ * ] Notice: The portion of the term of this patent subsequent to Apr. 10, 2007 has been disclaimed.

[21] Appl. No.: 428,118

[22] Filed: Oct. 27, 1989

Related U.S. Application Data

[63] Continuation of Ser. No. 157,606, Feb. 19, 1988, abandoned.

[51] Int. Cl.[5] ..... F26B 13/10

[52] U.S. Cl. ..... 34/44; 34/48; 34/54; 34/55; 34/202

[58] Field of Search ..... 34/48, 202, 55, 44; 219/370

[56] References Cited

U.S. PATENT DOCUMENTS 4,914,833 4/1990 Pilolla et al. ..... 34/44

*Primary Examiner*—Henry A. Bennett

*Attorney, Agent, or Firm*—Kinzer, Plyer, Dorn, McEachran & Jambor

[57] ABSTRACT

An automatic hand dryer contains a heating element and a motor which drives a squirrel cage fan. The fan exhausts air past the heating element to a downwardly-directed outlet. A base or mounting plate is adapted for flush mounting to a wall. The axis of the fan is peripendicular to the base plate and wall to which the dryer is attached. A control or sensing circuit emits signals to a detection zone beneath the outlet and monitors the zone for reflected signals indicative of a user's presence. The circuit operates to energize and deenergize the power circuit to the fan motor and heating element. Upon detection for a predetermined period, the circuit energizes the power circuit. The control circuit deenergizes the power circuit upon interruption of the reflected signals for a predetermined period, or after a predetermined maxium time period of continuous detection. Under the latter condition, the stimulus reflecting the emitted signals must be removed from the detection zone to reactivate the control circuitry. Any incremental interruption in the reflected signal which does not exceed the period of permitted interruption, restarts the commencement of the timing of the maximum period of continuous detection.

5 Claims, 5 Drawing Sheets

Fig. 1.
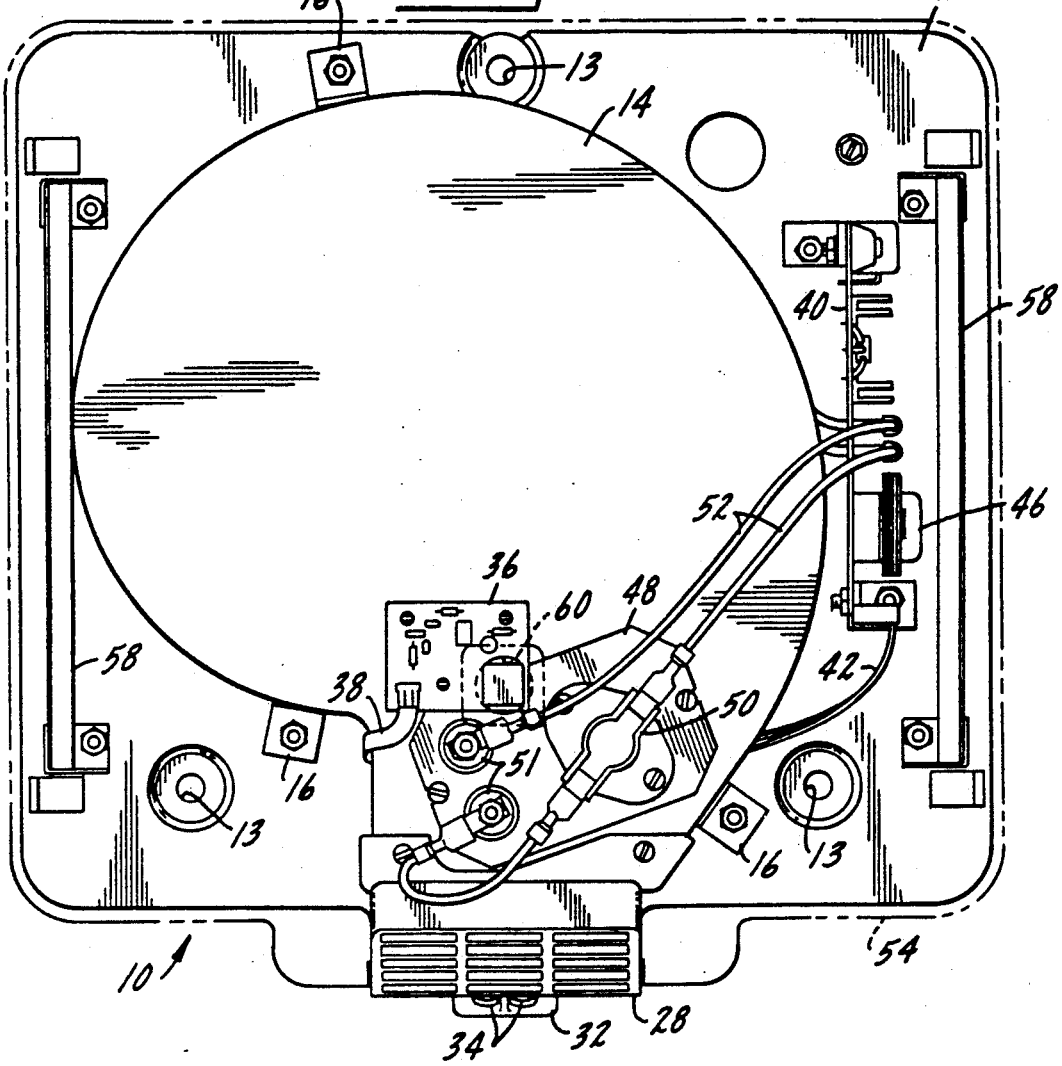
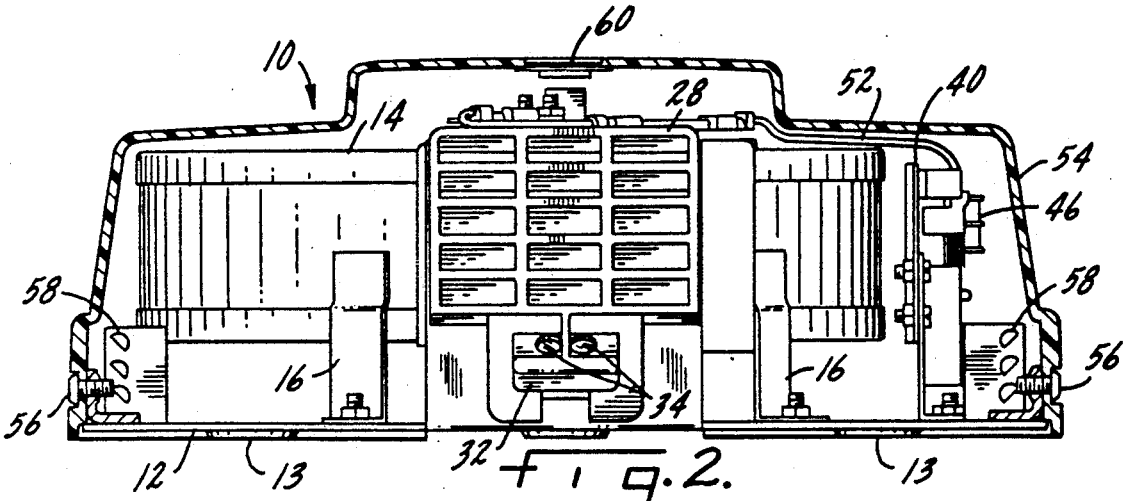
Fig. 2.

Fig. 3.
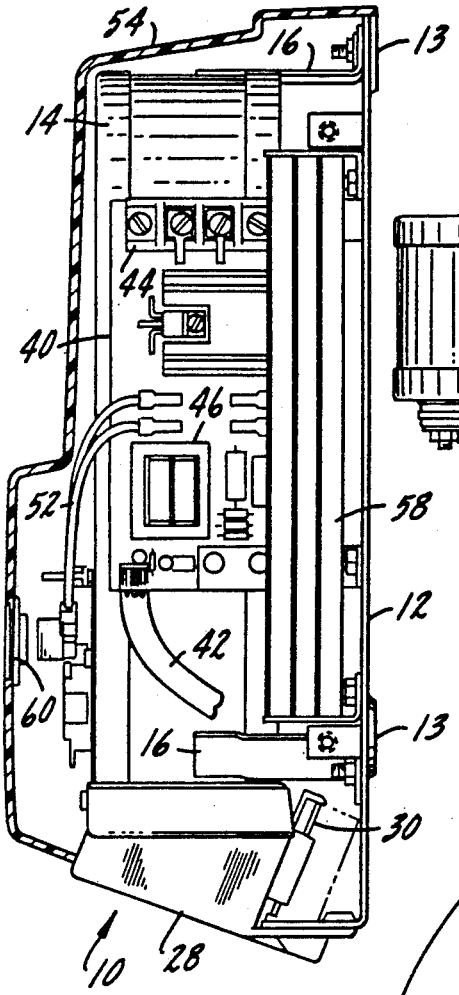
Fig. 4.
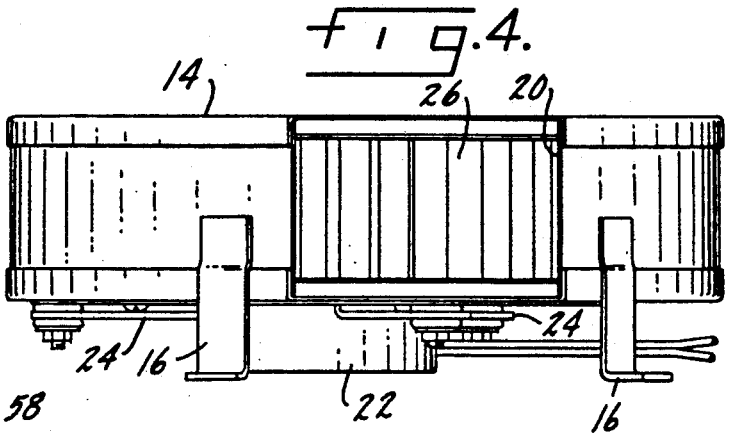
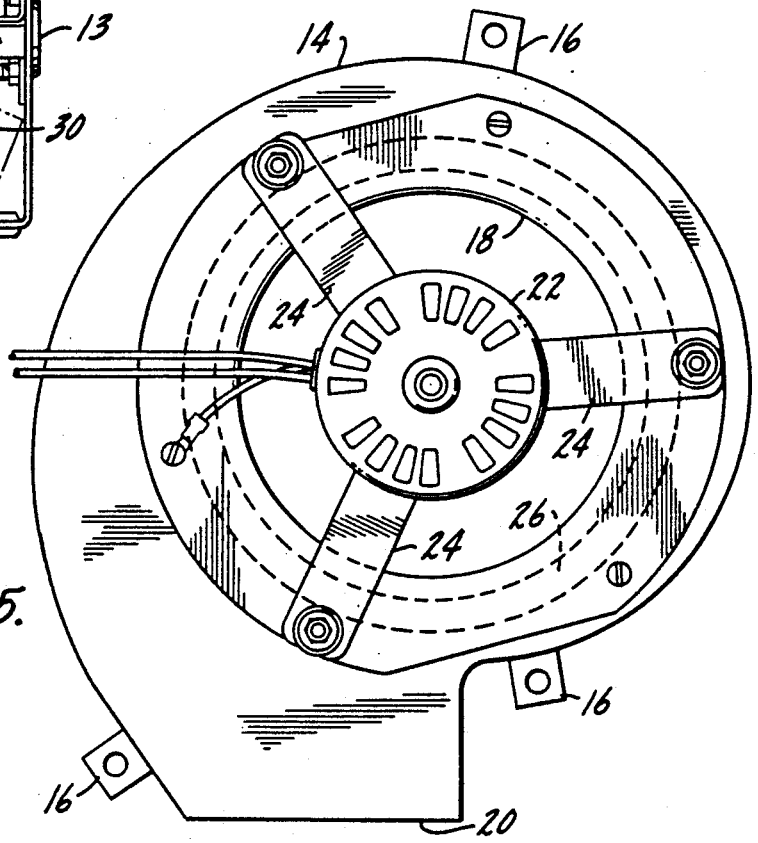
Fig. 5.

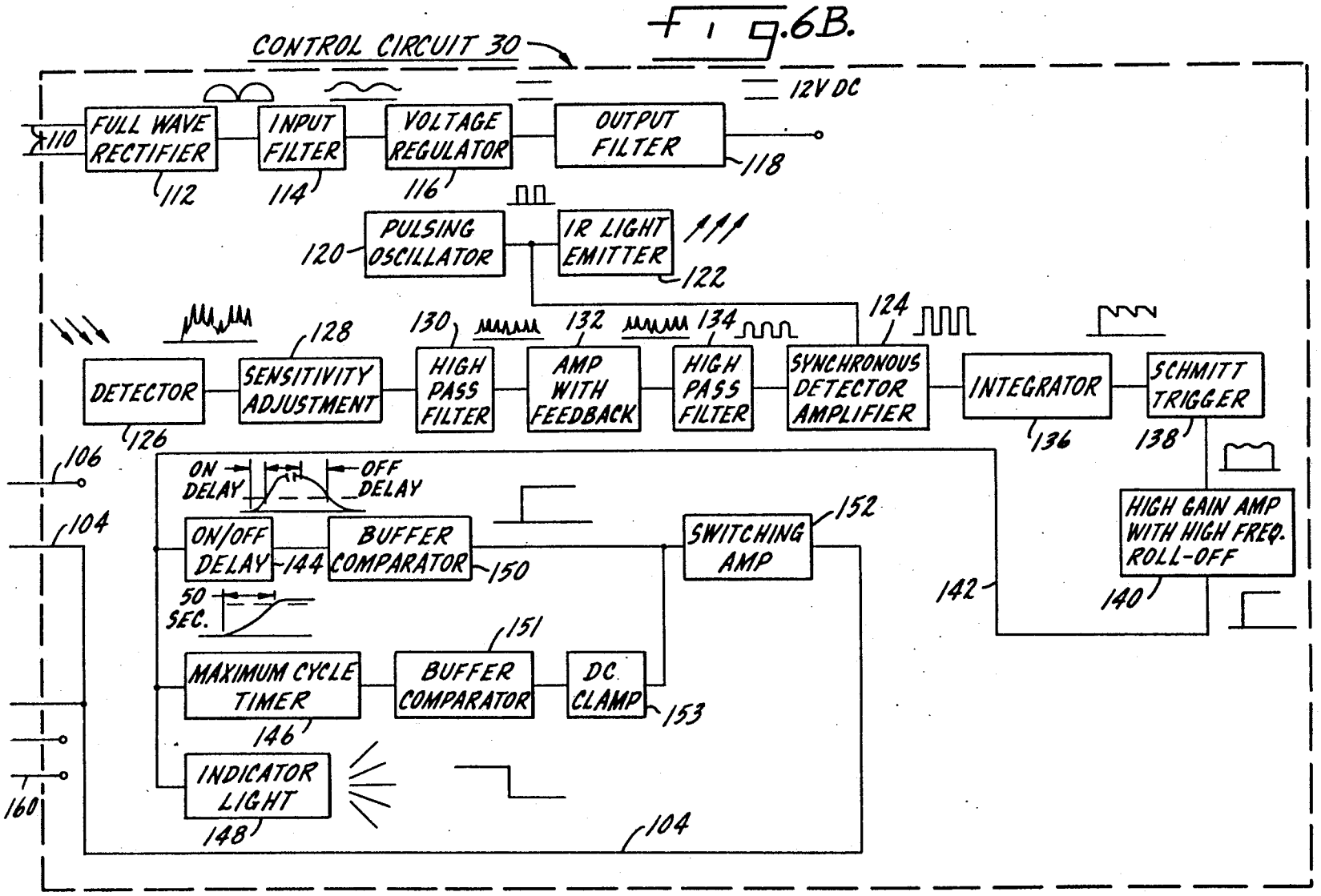
FIG. 6B.
CONTROL CIRCUIT 30
12V DC
FULL WAVE RECTIFIER
INPUT FILTER
VOLTAGE REGULATOR
OUTPUT FILTER
PULSING OSCILLATOR
IR LIGHT EMITTER
DETECTOR
SENSITIVITY ADJUSTMENT
HIGH PASS FILTER
AMP WITH FEEDBACK
HIGH PASS FILTER
SYNCHRONOUS DETECTOR AMPLIFIER
INTEGRATOR
SCHMITT TRIGGER
HIGH GAIN AMP WITH HIGH FREQ. ROLL-OFF
SWITCHING AMP
BUFFER COMPARATOR
ON/OFF DELAY
ON DELAY
OFF DELAY
50 SEC.
DC CLAMP
BUFFER COMPARATOR
MAXIMUM CYCLE TIMER
INDICATOR LIGHT
110
112
114
116
118
120
122
124
126
128
130
132
134
136
138
140
142
144
146
148
150
151
152
153
104
106
160

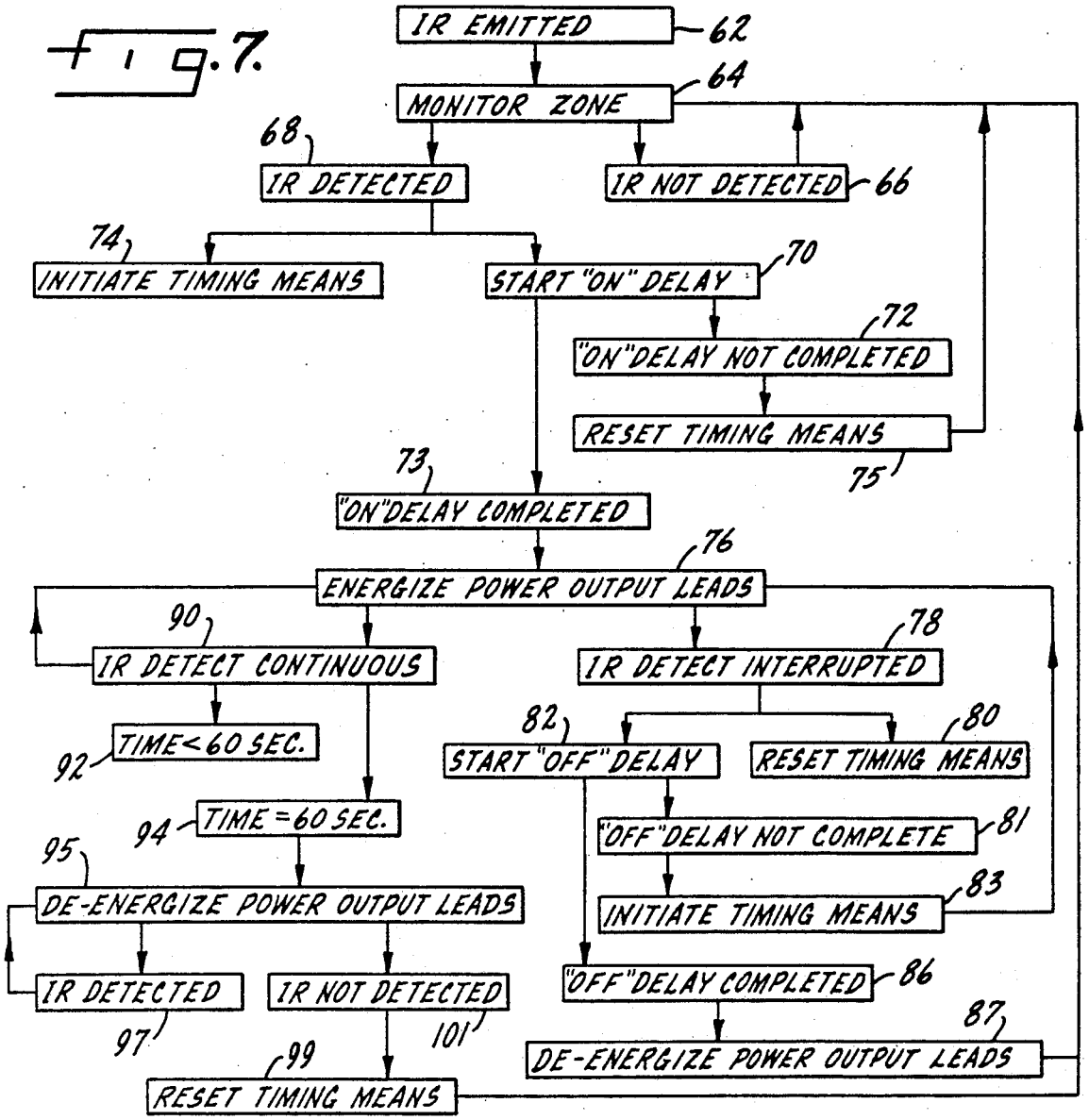
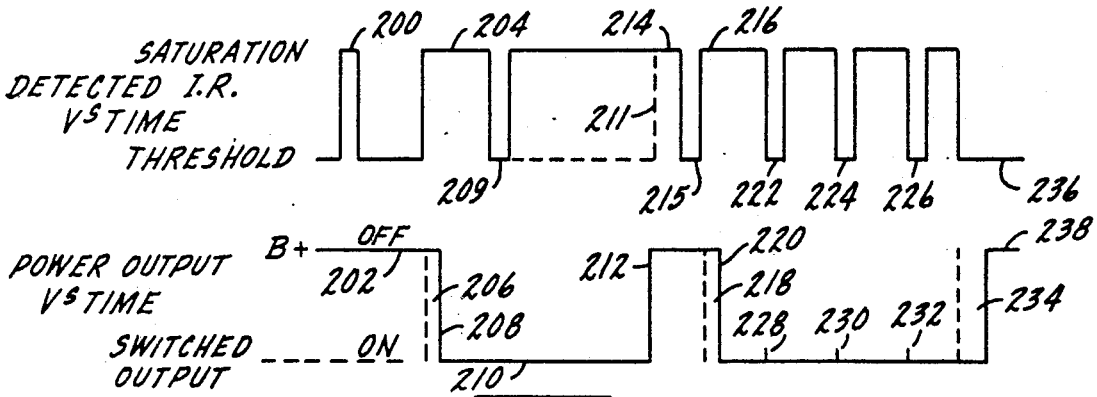
Fig. 8.

AUTOMATIC HAND DRYER

This is a continuation of Ser. No. 07/157,606 filed on Feb. 19, 1988, now abandoned.

BACKGROUND OF THE INVENTION

This invention relates to an automatic hand dryer of the type having a heater and fan arranged to blow hot air on a user's hands to dry them. More particularly, it relates to such dryers which sense the presence of a user to energize the dryer and additionally deenergize the power circuit after a predetermined time period regardless of whether the initiating stimulus remains present.

In the past, powered hand dryers have been somewhat bulky and noisy. This is typically due to the arrangement of the fan. Fans which have been used are of high speed in order to move suitable volumes of air. Large fans, in some instances, must extend into the wall upon which they are mounted. Dryers provided with a relatively smaller fan must rotate at a relatively high speed to generate sufficient air flow, which increases noise.

Another difficulty with previous hand dryers has been the power control. While a user-actuated switch and timer is a simple, straightforward approach, a more current approach is reflected by a dryer that can be activated without touching any part of the dryer. Various sensing devices and related control circuitry have been employed to automatically energize and deenergize dryers. Difficulties of inadvertent energizations or unnecessary extended operation when not actually being used for drying have detracted from this type of equipment.

SUMMARY OF THE INVENTION

The present invention provides an automatic hand dryer, which is compact in construction and quiet in operation. The dryer has a mounting plate for flush mounting on a wall and a removeable encasing cover made of metal or any other suitable material. The dryer includes a heating element and motor which drives a squirrel cage fan which directs air flow across the heating element. The squirrel cage fan rotor has its axis perpendicular to the dryer mounting plate and the wall on which the hand dryer is mounted. This arrangement allows for use of a large diameter, small width squirrel cage fan blower wheel which does not protrude excessively from the wall yet develops sufficient air flow to serve the intended purpose. The fan size permits use of a relatively slow speed drive motor to minimize overall noise.

The present invention also provides for automatic operation of the dryer through a sensing or control circuit which controls delivery of power to the motor and heater. The circuit emits signals to a detection zone and monitors the zone for reflected signals. Reflected signals indicative of the presence of a user cause the circuit to energize the power circuit. The control circuit provides an "ON" delay, an "OFF" delay and a time limit for operation due to continuous detection of reflected signals from the detection zone. The "OFF" delay permits momentary interruption of the detected signals without de-energization of the power circuit. Such interruption, in each instance, resets the commencement of timing of the period for operation due to continuous detection.

An emitter and detector are focused into the zone to which the heated air is discharged. The emitter transmits signals and the detector monitors this zone for reflected signals which indicate the presence of a user's hands. When a user is detected, the circuit initiates a timing means which monitors the predetermined period of operation due to continuous detection. It also initiates an "ON" delay in the control circuit. If the detection is continuous during the "ON" delay period, the circuit energizes the heating element and motor. If detection is interrupted during the "ON" delay period, the circuit simply reverts to its normal scanning mode.

When detection is interrupted during operation of the heater and fan, the timing means immediately returns to its initial or zero condition and will restart the timing of the period of continuous detection only after detection recommences.

An "OFF" delay is also initiated. If detection does not recur during the "OFF" delay, the heating element and motor are deengergized. If detection of the user is regained before the "OFF" delay times out, then the circuit maintains energization of the heating element and motor. Continuous detection for a period of time which reaches the predetermined maximum, for example, one minute, causes the timing means of the control circuit to deenergize the power circuit to the heater and motor regardless of the status of detection. If the power circuit is deenergized as a result of this action of the timing means, the stimulus causing reflection of signals must be removed from the detection zone to reactivate the control circuit.

BRIEF DESCRIPTION OF THE DRAWINGS

FIG. 1 is a front elevation view of the hand dryer with the cover shown in phantom.

FIG. 2 is a bottom plan view of the hand dryer with the cover in section.

FIG. 3 is a side elevation view as seen from the right side in FIG. 1, with the cover in section.

FIG. 4 is a bottom plan view of the fan housing.

FIG. 5 is a rear elevation view of the fan housing.

FIGS. 6A and 6B combine to form a functional block diagram of the control circuit.

FIG. 7 is a block diagram of the logic produced by the circuit of FIGS. 6A and 6B.

FIG. 8 is a timing diagram showing the output produced by the logic of FIG. 7.

DETAILED DESCRIPTION OF THE INVENTION

Figure 6A:
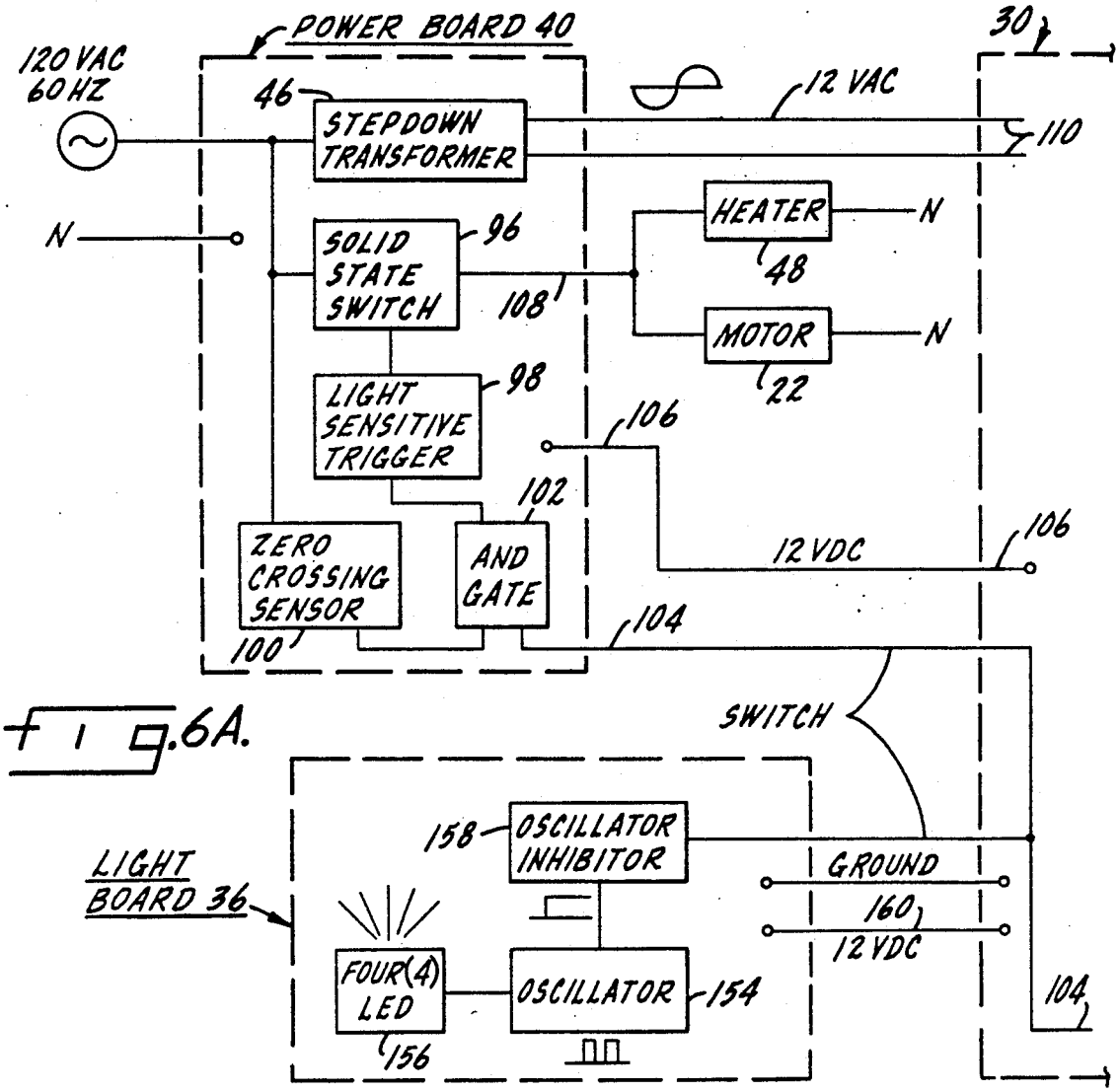

The hand dryer of the present invention is shown generally at 10 in FIGS. 1–3. The dryer includes a mounting plate 12 which is adapted for flush mounted attachment to a wall by means of bolts (not shown) extending through bolt holes 13. A fan housing 14 is connected to the mounting plate by brackets 16. On the rear side of the fan housing is an air inlet 18 (FIG. 5). The housing also has a downwardly-directed air outlet 20 (FIGS. 4 and 5) which defines a tangential portion to the otherwise generally-circular housing 14. A motor 22 is mounted to the housing 14 by clips 24. The motor is disposed in the center of the housing, through the opening 18.

A squirrel cage fan 26 is mounted in the fan housing on the motor shaft. The axis of the fan is perpendicular to the mounting plate 12, and hence, perpendicular to the wall. This allows the fan to have a relatively large diameter and a relatively small width. This combination provides a fan of sufficient air flow capacity while minimizing the distance which the fan and its housing must protrude from the wall. For example, it has been found that acceptable performance from the hand dryer can be achieved with a 2,000 watt heater and a 100 cubic feet-per-minute (CFM) fan. The fan of the present invention delivers this volume of air using a fan diameter of about 7⅛ inches and an axial width of about 2 inches, with a four pole, shaded pole, brushless motor having self-lubricated ball bearings and turning at about 1,745 rpm. At this speed the fan develops minimal noise while still providing adequate performance.

The remaining components of the hand dryer include an exhaust grill 28 attached to the air outlet portion 20 of the fan housing 14. The grill has a sufficiently large open area to permit approximately 100 CFM air flow to the user in a uniform temperature-velocity profile. It isolates all internal components from the user and prevents unwanted intrusion of objects. It also holds and positions the sensing devices and control circuitry which are mounted on a control circuit board 30 seen in FIG. 3.

The control circuitry includes infrared emitting diode and detecting phototransistor mounted in a holder portion 32 of the grill. (See FIG. 2.) The holder has openings 34 which permit access to the light emitting and detecting devices. A suitable emitting diode is an OP295C gallium aluminum arsenide infrared emitting diode available from the Optoelectronics Division of TRW Electonic Component Group, Carrollton, Tex. A suitable phototransistor is the OP501 SLA NPN silicon phototransistor available from the same source.

The control circuit board 30 is connected to a light board 36 by a cable 38 (FIG. 1). The light board has four LED'S which are visible through a cover to indicate to the user the status of the hand dryer, as will be explained.

The control circuit board 30 is also connected to a power board 40 by a cable 42. The power board incorporates all the internal electrical control components and power routing on a single PC board. It has a terminal block 44 for accepting input 120 volts A.C. (VAC) power. There is also a step down transformer 46 which drops the 120 volts A.C. (VAC) to 12 volts A.C. (VAC).

The power board distributes power to the heater assembly 48 which is mounted on the front of the housing 14. The heater assembly 48 includes a thermostat 50 and a heating element 51 which extends down into the fan housing at the air outlet 20. The power board and heater assembly are connected by electrical cables 52.

The entire hand dryer is enclosed in an encasing removeable cover 54 which is attached to the mounting plate 12 by bolts 56. It extends about all sides of the dryer to the flush mounting plate 12. It is made of a suitable metal or other suitable material.

Air is permitted to enter the hand dryer through side openings in the cover. These openings are protected by safety shields 58 mounted on the mounting plate 12. The cover includes an opening 60 providing visual access to the LED's on the light board 36.

Turning now to the operation of the control circuit, the logic performed is shown in FIG. 7. As mentioned above, the control circuit includes light emitting diode and detecting phototransistors which emit and detect infrared light. So FIG. 7 shows at 62 that infrared light is emitted intermittently into the detection zone and the zone is monitored by a synchronized infrared detecting phototransistor, as indicated at 64. If no reflected IR (infrared) signals are received, 66, the emitter simply continues to send timed pulses of light and synchronized monitoring of the zone continues. When reflected IR signals are detected, 68, the control circuit initiates a timing means 74, which monitors the period of continuous detection and limits that period to a preset or predetermined maximum The circuit also initiates an "ON" delay 70, which must expire before the dryer is energized. The "ON" delay is about half a second. If IR detection is lost before the "ON" delay is completed, 72, no energization of the power circuit occurs and detection simply continues to monitor the detection zone and the timing means 75 is reset to zero. If detection is sustained throughout the "ON" delay 73, the circuit energizes the power output leads 76 to send electric power to the motor and heater, thus energizing the hand dryer.

If the IR detection is interrupted 78 the timing means returns to its initial or zero condition 80 and an "OFF" delay of about two seconds is initiated 82. If the IR signal is not regained before completion of the "OFF" delay 86 power to the output leads is terminated 87. If detection resumes, the cycle commences from 68. Detection will start the "ON" delay and initiate the timing means 74. If detection is regained before the "OFF" delay times out 81, the timing means for limiting the maximum period of operation due to continuous detection is again initiated 83 and power to the motor and heater continues to be energized.

So long as the IR detection is continuous, the timing means measures the time period of such continuous detection, as at 90. If the period is less than a predetermined limit, such as 60 seconds, 92, power to the heater and motor is maintained. If the period reaches the limit, which is illustrated as 60 seconds, 94, the motor and heater are de-energized at 95 without regard to the IR detection status at that time.

When the power to the motor and heater is deenergized by expiration of the predetermined limit or maximum period of continuous detection, as established by the timing means, further continuous detection is ineffective to reenergize the power circuit 97 because the control circuit is not in a status to energize the power output leads. Detection must be interrupted 101 to cause the detection portion of the control circuit to once again respond to reflected signals. Once such interruption in detection takes place, the timing means 99 is reset to zero and the cycle logic previously described is repeated. It should be noted that, if desired, the "ON" delay may be eliminated and the timing means and power output leads energized simultaneously. Also, the maximum period of continuous detection may be varied as desired.

Turning now to FIGS. 6A and 6B, a functional diagram of a circuit for performing the logic of FIG. 7 is shown. The circuit has three main parts: the control circuit board 30, the power board 40, and the light board 36. Standard 120 VAC, 60 Hz power is supplied to the power board 40 where it is routed to the step down transformer 46 and a solid state switch 96, which may be a triac. The switch 96 is controlled by an optically isolated, zero crossing track driver comprising a light sensitive trigger 98, a zero crossing sensor 100 and an AND gate 102. The zero crossing sensor 100 receives power from the main supply and is connected to the AND gate 102. The AND gate also receives a signal from a switched output line 104, which will be described further below. The triac driver receives a 12 volt DC input through line 106. Line 108 connects the output of the triac 96 to the motor 22 and heater 48.

The step down transformer supplies 12 VAC through lines 110 to a full wave rectifier 112 on the control circuit board 30. An input filter 114, voltage regulator 116 and output filter 118 create a 12 volt DC source for use by the rest of the circuitry. The 12 volt DC is supplied to the power board through line 106, and the light board 36 through line 160. A pulsing oscillator 120 which is connected to the infrared light emitter 122. The oscillator 120 is also connected to a synchronous detector amplifier 124 which permits processing of detected signals only during such time as signals are being emitted. The infrared light detector 126 passes incoming signals to a sensitivity adjustment 128, a high pass filter 130, an amplifier with feedback 132, and a second high pass filter 134. If these signals are received during such time as the synchronous detector amplifier 124 is activated by the oscillator 120, the amplified signals are passed to an integrator 136, a Schmitt trigger 138 and a high gain amplifier with high frequency roll-off 140. The resulting signal is passed through line 142 to the "ON/OFF" delay circuit 144, the timing means 146 (which is the maximum continuous detection control described in reference to FIG. 7) and an indicator light 148. Two buffer comparators 150 and 151 are used to determine whether the "ON" delay, "OFF" delay or maximum cycle times have been exceeded. The signals are then fed to a switching amplifier 152, which provides the switched output on line 104 to the power board 40 and to the light board 36.

The circuit is arranged such that when continuous detection exceeds the predetermined limit set in the timing means, the buffer comparator 151, through D.C. clamp 153, supplies a signal to switching amplifier 152, which causes the output to send a signal to the solid state switch circuitry to cause it to deenergize the power circuit regardless of the condition of the signal from "ON/OFF" delay 144.

The light board receives a 12 VDC power source from the output filter 118. The light board is also grounded to the control circuit board 30. An oscillator 154 drives four LED's, shown at 156. An oscillator inhibitor 158 receives the switched output from line 104. When the switched output goes low, the inhibitor disables the oscillator, and it continuously supplies power to drive the LED's and the LED's are continuously illuminated.

FIG. 8 illustrates a timing diagram showing the operation of the circuit of FIG. 6. If there is momentary detection of recovered IR as at 200 of less than half a second, there is no effect on the switched output 202, and the triac driver on the power board does not turn on the triac. When there is continuous detection of recovered IR 204 longer than the "ON" delay 206, the switched output from amplifier 152 goes low after the "ON" delay time period 208. If there is interrupted detection for less than the "OFF" delay 209, the switched output stays low 210 despite the interruption. The output 210 stays low until the 60 seconds of the maximum cycle timing means has been reached 211, at which time the power output goes high 212, turning off the triac driver and the triac despite continued detection of recovered IR 214. The triac remains off regardless of continued detection until there is an interruption in detection 215. A resumption in detection 216 longer than the "ON" delay 218 causes the power output to go low 220 and turns on the triac. Interruptions in detection less than the "OFF" delay 222, 224, and 226 have no effect on the power output. It should be noted, however, that since each such interruption restarts the maximum cycle timing means (228, 230, and 232), the measurement of the period of maximum cycle recommences with each such interruption. Therefore, power could remain on indefinitely if interruption in detection less than the "OFF" delay occurred at intervals less than the maximum cycle time period. If an interruption in detection longer than the "OFF" delay 234 occurs 236, the power output goes high 238 and disengages the triac.

It can be seen that the described circuit will operate when a user places his hands in the detection zone and remains there for a short moment, but the dryer will not operate for an overly long period of time, which would waste power. Neither will the dryer operate in response to momentary or passing signals, but it will not shut off if a user momentarily removes his hands from the detection zone.

Whereas a preferred form of the invention has been shown and described, it will be understood that modifications may be made thereto without departing from the scope of the following claims. It should be appreciated that while the circuit is described in connection with the dryer of the present invention, it has a variety of other applications. It could, for example, be utilized in the automatic control of a water faucet or the like.

What is claimed:

1. A system having a device which is remotely controlled by a user, comprising:

sensing means for detecting the presence of a user within a detection zone in close proximity to the controlled device;

means responsive to the sensing means for energizing the controlled device for an indeterminate period of time when a user is detected in the detection zone;

a timing means, responsive to the sensing means, for de-energizing the controlled device after detection has been continuous for a predetermined period; and means, including a time delay mechanism and operative after a user has been detected, for maintaining continuous energization of the controlled device even though the user subsequently moves momentarily outside of the detection zone and detection is interrupted, thereby permitting the user to move in and out of the detection zone without de-energizing the device.

2. The system of claim 1 wherein the momentary interruption of detection must be less than an "OFF" delay of four seconds in order for the time delay mechanism to ensure that there is no loss in the energization of the controlled device.

3. The system of the claim 1 and including means for maintaining the controlled device de-energized until after the user moves out of the detection zone, whereupon the timing means is reset and conditioned to respond to the sensing means the next time a user is present in the detection zone.

4. The system of claim 1 wherein the timing means starts timing the predetermined period when detection initially occurs and completes the period when there is continuous detection during that time, any interruption of detection causing the timing means to reset to zero and to start another timing cycle.

5. The system of claim 1 wherein the controlled device comprises a heating element in a hand dryer, wherein the sensing means includes an infrared light emitter and an infrared light detector which receives and detects light reflected off of the user's hands when in the detection zone, wherein the time delay mechanism provides a preset "ON" delay between the initial detection and before the controlled device is energized and a preset "OFF" delay between the interruption of detection and before the controlled device is de-energized, wherein the timing means is reset to zero upon interruption of detection, energization of the controlled device being continuously maintained if detection is momentarily interrupted for an interval less than the "OFF" delay, but de-energization occurring whenever the timing means senses the predetermined period of continuous detection regardless of whether the user is still present in the detection zone and is being detected.

* * * * *